United States Patent [19]

Milligan

[11] Patent Number: 4,562,627

[45] Date of Patent: Jan. 7, 1986

[54] METHOD FOR FINISH DRYING OF TUBULAR KNITTED FABRICS

[75] Inventor: William D. Milligan, Matthews, N.C.

[73] Assignee: Samcoe Holding Corporation, Woodside, N.Y.

[21] Appl. No.: 575,801

[22] Filed: Feb. 1, 1984

[51] Int. Cl.[4] ..... D06C 5/00; D06C 21/00; D06C 27/00

[52] U.S. Cl. ..... 26/18.5; 26/18.6; 26/81; 34/115

[58] Field of Search ..... 26/81, 18.5, 18.6; 34/115

[56] References Cited

U.S. PATENT DOCUMENTS

| | | | |
|---|---|---|---|
| 2,228,001 | 1/1941 | Cohn et al. | 26/84 |
| 2,270,125 | 1/1942 | Hurxthal | 26/81 X |
| 2,271,347 | 1/1942 | Runals | 34/115 UX |
| 2,301,249 | 11/1942 | Butterworth et al. | 34/115 X |
| 2,597,530 | 5/1952 | Redman | 26/81 X |
| 3,065,551 | 11/1962 | Cohn et al. . | |
| 3,102,006 | 8/1963 | Cohn et al. . | |
| 3,175,272 | 3/1965 | Cohn et al. | 26/84 |
| 3,207,616 | 9/1965 | Cohn et al. . | |
| 3,496,647 | 2/1970 | Frezza . | |
| 4,173,812 | 11/1979 | Cecere | 26/84 |
| 4,262,397 | 4/1981 | Cecere | 26/84 |

FOREIGN PATENT DOCUMENTS

| | | | |
|---|---|---|---|
| 2137377 | 2/1973 | Fed. Rep. of Germany | 34/115 |
| 2624439 | 12/1977 | Fed. Rep. of Germany | 26/81 |
| 2006500 | 12/1969 | France | 34/115 |
| 415466 | 7/1974 | U.S.S.R. | 34/115 |

OTHER PUBLICATIONS

Tube-Tex Pamphlet entitled 9-60 Tri-Pad (4 pages).
Rotoswing Pamphlet (2 pages).
Heliot Pamphlet (4 pages).

*Primary Examiner*—Robert R. Mackey
*Attorney, Agent, or Firm*—Mandeville and Schweitzer

[57] ABSTRACT

An process is disclosed for finish drying of tubular knitted fabrics from a wet condition to a substantially finished form in a single process. Wet treated and mechanically extracted fabric is significantly overspread laterally as it enters the upstream end of the dryer and, importantly, although already wet, the fabric is steamed. Thereafter, and throughout most of its travel through the dryer system, the fabric is handled with special care to avoid stitch tension to the greatest possible extent while the wet fabric is assuming geometric stability. The discharged fabric is unique in comparison to conventionally dried fabric in that it is virtually finished and ready for the cutting table. The invention also makes possible mechanical roller compacting of fabrics in wet condition, enabling the wet-compacted fabric to be dried to a substantially finished condition without significant loss of its compacting.

7 Claims, 9 Drawing Figures

METHOD FOR FINISH DRYING OF TUBULAR KNITTED FABRICS

BACKGROUND AND SUMMARY OF THE INVENTION

In the processing of tubular knitted fabric, it is typical for the fabric to be wet processed at one or more stations, as in bleaching, dyeing, resinating and similar operations. The term "wet" processing, as used herein, refers to "foam" processing as well as to more conventional liquid processing. Because of the construction of knitted fabrics, wet tubular fabrics are extremely unstable, geometrically, and tend to become elongated and distorted during wet processing. Accordingly, the processing techniques for tubular knitted fabrics have conventionally included a final operation of spreading the dry fabric to width in the presence of steam, so that the final product has a desired width and geometric uniformity. At this stage, it is often necessary and desirable to perform certain additional adjustments on the fabric geometry, such as stripe straightening, in the case of fabrics having pronounced transverse stripe configurations.

In the wet processing of tubular knitted fabric, it typically has been necessary to perform finishing operations such as spreading to width, stripe straightening, etc. after the drying operation, depending somewhat on the character of the drying operation. In some instances, where a so-called Palmer-type dryer is employed, the fabric can be physically confined between a heated drum and a blanket, during the drying operation, such that the dried fabric being discharged from the dryer has a generally controlled geometry. However, dryers of this type are generally quite slow and have other disadvantages. More widely used are dryers in which the fabric is advanced on mesh-like drums or conveyors and relatively high velocity streams of air are passed through the fabric to remove moisture. Such dryers have many advantages in relation to speed and efficiency, but typically do not accommodate a high degree of control of fabric geometry, and post-drying finishing operations, such as spreading and steaming, stripe straightening, etc., typically are required.

In accordance with the present invention, a unique and extraordinarily effective method is provided for the drying of tubular knitted fabric, utilizing flowing streams of heated air, but under such conditions that the dried fabric emerging from the dryer unit is in substantially finished condition, of highly uniform width and geometry, substantially ready for the cutting table.

In accordance with one of the significant features of the invention, wet fabric delivered to the dryer is significantly but controllably overspread in terms of the ultimate width desired and, although the fabric is completely wet at that stage, it is nevertheless steamed as it enters the dryer. From that point, and throughout a substantial fraction of the path through the dryer, the fabric is carefully controlled and supported in terms of its geometry, so that the fabric remains as free as possible from tensions in any direction, particularly lengthwise, and unsupported traverses of the fabric are kept at an absolute minimum. The arrangement is such that, as the fabric traverses the drying system, although it loses some of the width imparted by overspreading at the entry, it loses such width in a highly controllable, uniform basis, resulting in fabric which, as discharged from the dryer, is of highly uniform width and cross line geometry, substantially ready for cutting. In a typical case, the fabric may in fact be calendered after drying, but primarily for "packaging" purposes, without significant width and/or stripe adjustment.

In the procedure of the invention, the starting material frequently (but not necessarily) is a heat settable tubular knitted fabric, rendered such either by reason of a poly/cotton construction in the first instance, or by reason of the addition of heat settable resins during wet processing. During the traverse of the drying system, the fabric becomes set and emerges from the discharge end of the dryer system as cured or set, finished fabric. With more conventional drying techniques (with perhaps the exception of the Palmer-type dryer, which has other disadvantages), it is usually necessary to dry without curing, because of the unsuitable geometry of the fabric as it reaches the discharge end of the dryer. This necessitates subsequent operations of calendering and stripe straightening, in conjunction with curing of the resin or setting of the polyester component, as the case may be.

In accordance with one aspect of the invention, the fabric, immediately or shortly preceding the drying operation, is wet processed and passed through an extractor nip, being discharged therefrom with a rather uniform moisture content typically ranging from about 60 to 100% moisture by weight of dry fabric for conventional wet processed fabrics, and around 25% for foam processed fabrics. In an in-line operation, the fabric travels directly from the wet processing stage to the entry spreader for the dryer system. More typically, since the line speeds of the wet processing equipment and the drying equipment may not be the same, and/or it may be desired to run more than one fabric string, the fabric may be discharged from the wet processing operation onto a truck or the like, from which it is later drawn into the dryer entry.

In another aspect of the invention, tubular knitted fabric may be directed into the new dryer system on an in-line basis from a mechanical compacting line operated on a wet basis. Heretofore, mechanical compressive shrinkage (compacting) of tubular knitted fabric for preshrinkage purposes has been performed on essentially dry fabric, which is steamed in advance of the processing nip. Compacting of the fabric in wet condition has, heretofore, been accomplished only with difficulty and expense, because of the problems involved in drying of the fabric subsequent to mechanical compacting, without loss of the compacting effect and geometry of the fabric. Where such practices have been carried out, typically it has required the use of a Palmer-type dryer with its attendant slow speed and other disadvantages. Pursuant to the present invention, wet compacted fabric may be discharged directly from the compactor into the entry of the dryer system and dried and set at economical speeds yet under a high degree of effective control, such that finished, compacted fabric emerges from the discharge side of the dryer.

The principles of the invention not only result in very significant economies in the finish processing of tubular knitted fabrics, but also achieve a more desirable product. Among the important advantages realized are that the fabric may be initially constructed with a somewhat looser stitch, which enables a higher yield of fabric to be achieved with a given weight of yarn.

For a more complete understanding of the above and other features and advantages of the invention, reference should be made to the following detailed description of preferred embodiments of the invention and to the accompanying drawings.

DESCRIPTION OF PREFERRED EMBODIMENTS OF THE INVENTION

Figure 1:
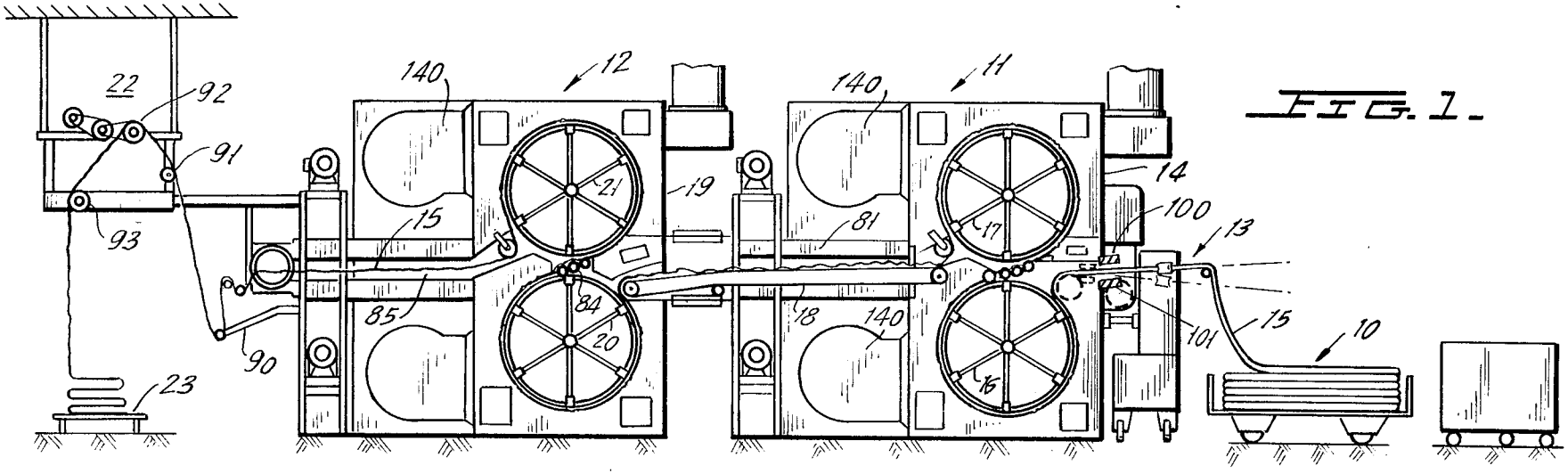
FIG. 1 is a simplified representation, from a side elevational view, of a wet processing and drying system adapted especially for practice of the invention.
Figure 2:
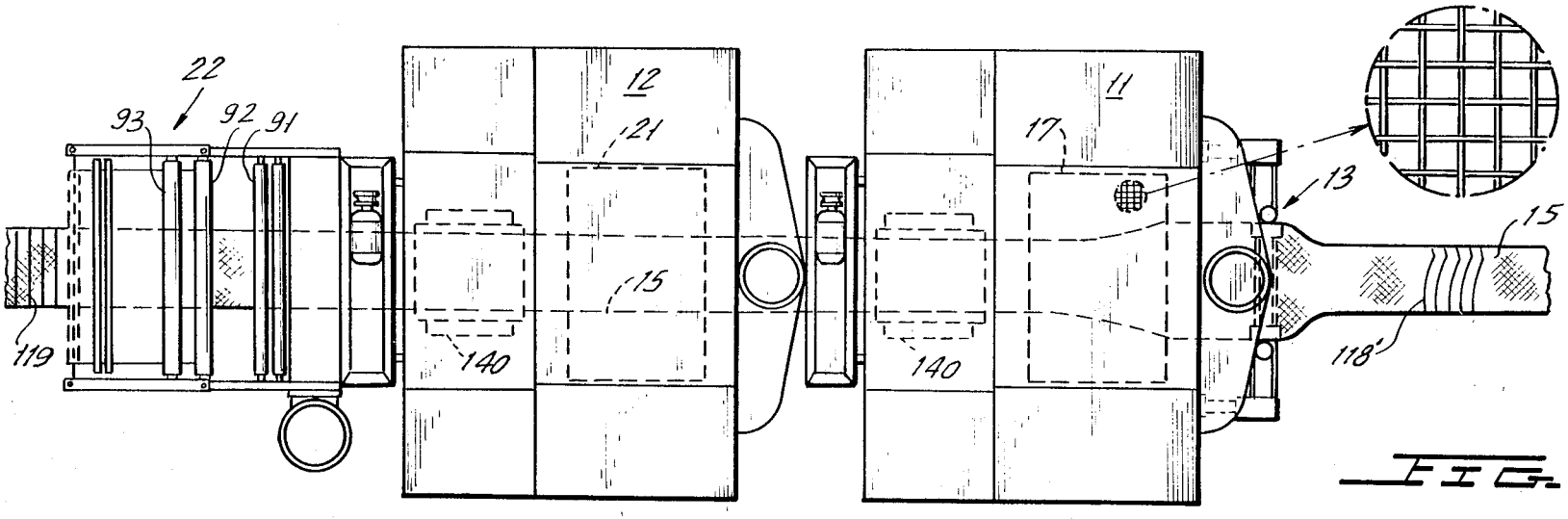
FIG. 2 is a top plan view of the system of FIG. 1.

Referring now to the drawing, and initially to FIGS. 1 and 2 thereof, the reference numeral 10 designates in a general way a supply truck, holding a supply of flat-folded, wet tubular knitted fabric which is ready for further processing. The supply truck is mobile, so as to facilitate its movement from a wet-processing line (not shown in FIG. 1) to a position directly in front of the dryer system.

In the illustrated arrangement, the dryer system includes a pair of two-reel dryers, connected in tandem, designated respectively by the reference numerals 11, 12. It will be understood, of course, that the specific number of reels, and the specific arrangement of the dryer units, whether in tandem or in a single integrated dryer housing, is usually a matter of convenience and is not a critical aspect of the invention.

As will be described in greater detail hereinafter, fabric 15 is drawn from the supply truck 10 and passed over an entry spreader, generally designated by the numeral 13 and discharged into the interior of the first stage dryer housing 14. The wet fabric is laterally distended substantially beyond its desired final width by the entry spreader 13, and then it is discharged into the interior of the housing. As will be explained in detail, the fabric is then guided and conveyed throughout the first dryer stage 11, with the utmost attention to maintenance of the fabric in a totally tension free condition, both widthwise and lengthwise. During this phase, the fabric 15 is supported on and conveyed by rotating, mesh covered dryer reels 16, 17, with drying air being directed through the fabric as it is conveyed by the rotating reels.

After being passed around the second reel, and still while being maintained with the utmost attention to tension free condition of the fabric, the fabric is discharged in an overfed condition onto a conveyor 18, which advances the fabric into the second stage dryer housing 19, for passage around a second pair of dryer reels 20, 21. The conveyor 18 desirably is driven at a speed slightly less than that of the reel 17. The fabric deposited on the transfer conveyor 18 thus is overfed to a limited degree onto the upper reach of the conveyor. During its travel on the conveyor, the fabric continues to be exposed to the flow of streams of dry, heated air, such that the heating/drying process continues on the conveyor.

The transfer conveyor 18 ultimately discharges the fabric onto the lower reel 20 of the second dryer unit. Desirably, the effective speed of the dryer reel 20 is slightly less than that of the upper reel 17 of the first unit 11, and slightly greater than that of the transfer conveyor 18. The arrangement is such that, while the fabric on the conveyor 18 is not placed under lengthwise tension, a portion of the fabric overfeed is drawn out, allowing the fabric to lie somewhat flatter on the dryer reel 20. In passing around the dryer reels 20, 21 of the second unit, continued attention to detail is observed in maintaining the fabric free of tension, and the drying and heating process continues to the point where the fabric is fully dried, in a normal sense. If the fabric is heat settable, it is further heated to a level where its yarns (in the case of heat set yarns such as polyester) or its resins (in the case of heat curing resins), have been set or cured to give a greater degree of geometric stability and permanence to the fabric. Upon discharge from the upper reel 21 of the second dryer reel unit, the fabric 15 is conveyed through a cooling section. The discharged fabric is then directed to a folding station 22 which folds the fabric in layers on a pallet 23, for example. The fabric at this stage is substantially in finished form, with straight-across stripe configuration and highly uniform width. In many cases, the fabric may be cut into garments at that stage. Frequently, however, it may be put into roll form, by passage over a finishing spreader with minimum processing and width adjustment.

Figure 3:
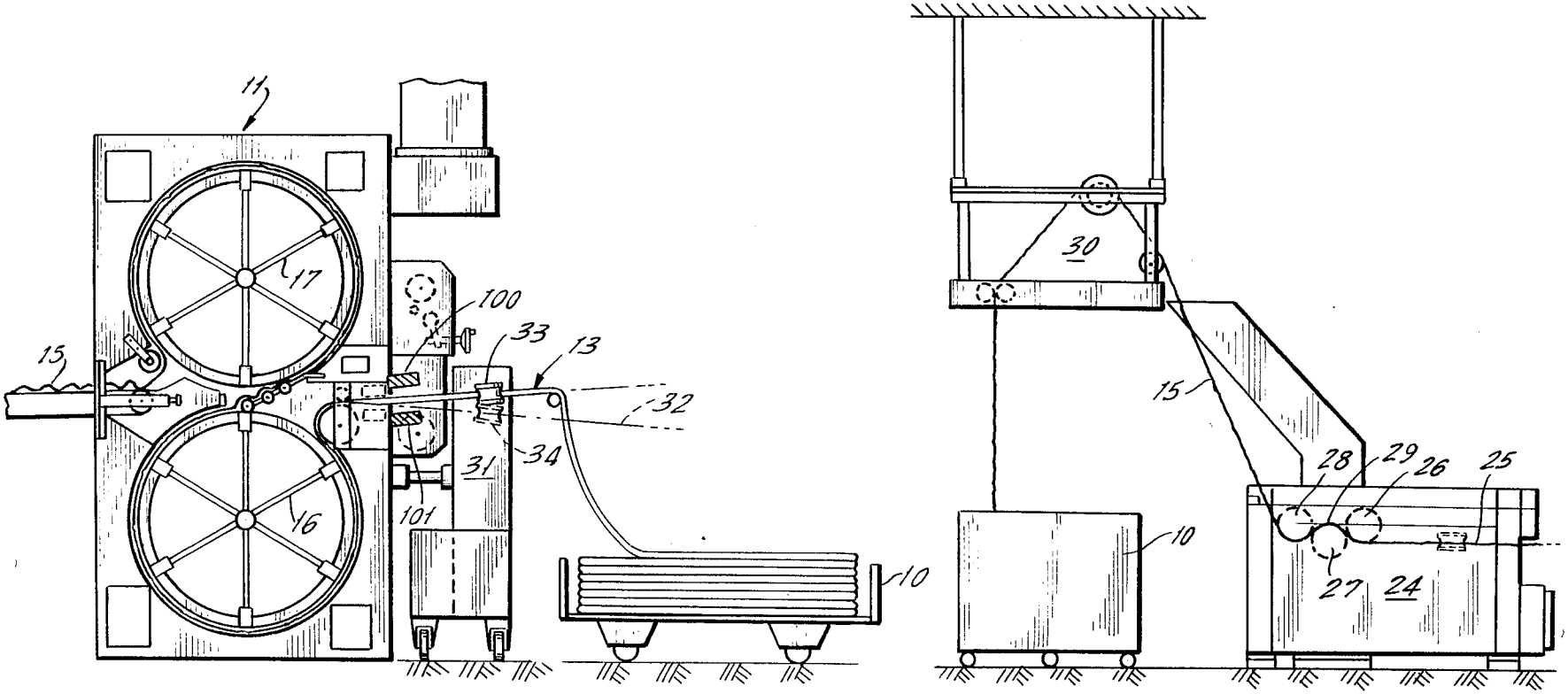
FIG. 3 is an enlarged, representative elevational view of the system of FIG. 1, illustrating a typical form of wet processing apparatus useable in conjunction therewith.

With reference to FIG. 3, a typical wet processing of the fabric might include, as a final operation, passage through a machine such as a "9-60 Tri-Pad" as marketed by Tubular Textile Machinery Corp., Woodside, New York/Charlotte, N.C. In general, the Tri-Pad equipment functions more or less in accordance with the teachings of the S. Cohn et al. U.S. Pat. No. 3,207,616, the disclosure of which is incorporated herein by reference. In a typical case, wet-procesed fabric from earlier operations, such as bleaching, dyeing, etc. may be supplied in a truck, generally in rope form. The fabric is drawn out of the truck (not shown), detwisted if necessary, and applied to the entry end of a belt spreader device 25, which forms the entry section of the Tri-Pad unit 24. The spread-flat fabric is discharged from the spreader directly into the first of two nips, formed by triangularly configured processing rollers 26–28 which, among them, form a reservoir 29 for additional processing liquid. As the fabric passes through the first roller nip 26–27, excess water is extracted from the fabric by the pressure of the roller nip. This reduces the liquid content of the incoming fabric which, as soon as it reaches the exit side of the nip, is immediately exposed to the reservoir 29, typically containing a further processing liquid, which may include finishing chemicals, heat curable resins, etc. The fabric then leaves the reservoir through the roller nip 27–28, which extracts excess chemical solution and discharges the fabric in flat, uniform width condition with a uniform liquid content. At this stage, although the fabric may be advanced on an in-line basis into the dryer section, it is frequently more advantageous to pass the wet-treated fabric 15 through a folder station 30. The folder lays the fabric in a series of flat folds in a mobile container truck 10, which can be wheeled to the entry of the dryer line. This provides for delivery of the output of a wet processing line to more than one dryer line, for example, in cases where the line speed of the wet processing system is greater than that of the dryer system.

Positioned directly in front of the first dryer section 11 is a spreader unit 31 which, while having a degree of portability, is firmly attached to the dryer unit during normal operation. Depending on the width of the fabric being processed, the spreader unit 31 may comprise a single spreader frame 13, in the case of wide fabrics, or a second spreader unit, schematically indicated at 32, where the fabric being processed is narrow enough to accommodate more than one width side-by-side on the dryer reels 16, 17. Where side-by-side operation is provided for, the spreader frames 13, 32 are disposed in different planes, converging at the discharge point, to provide adequate clearance for their respective edge drive rolls 33, 34, in accordance with generally known principles. For the purpose of this description, it can be assumed that only a single strand of fabric 15 is being processed, using a single spreader section.

In accordance with one aspect of the invention, the incoming, wet processed fabric is significantly distended laterally, not only in relation to its incoming width, but in relation to the desired end width of the fabric. Pursuant to the invention, the faric is distended to a width of from about 115% to about 200% of the desired finished width. By way of rather extreme example, a poly/cotton interlock fabric having an exit width from the Tri-Pad of approximately twenty inches, might be distended on the spreader to a width of forty-one inches. This is enabled by reason of the significant features of the equipment to be more fully described and has advantages even at the Tri-Pad stage, which precedes the spreading. In this respect, because the dryer system according to the invention accommodates an extreme degree of lateral distention of the fabric without losing control, and with the necessity of post-drying width adjustment procedures, lateral distention at the earlier Tri-Pad stage may be kept at an absolute minimum. Indeed, the exit width of the fabric at the Tri-Pad may, under the procedures of the invention, be the natural, grey width of the fabric, whereas heretofore considerable width distention has been required to be performed at the Tri-Pad.

The ability to avoid significant width distention at the Tri-Pad has important processing advantages, because the supply fabric to the Tri-Pad typically is in twisted, rope form, and the procedures for applying the fabric to the entry end of the Tri-Pad involve considerable operator attention in feeding the fabric "on edge" to the Tri-Pad spreader. This task is enormously facilitated where the fabric distention at the Tri-Pad spreader is minimal, enabling higher operating speeds to be realized along with a higher level of product quality.

Figures 8, 9:
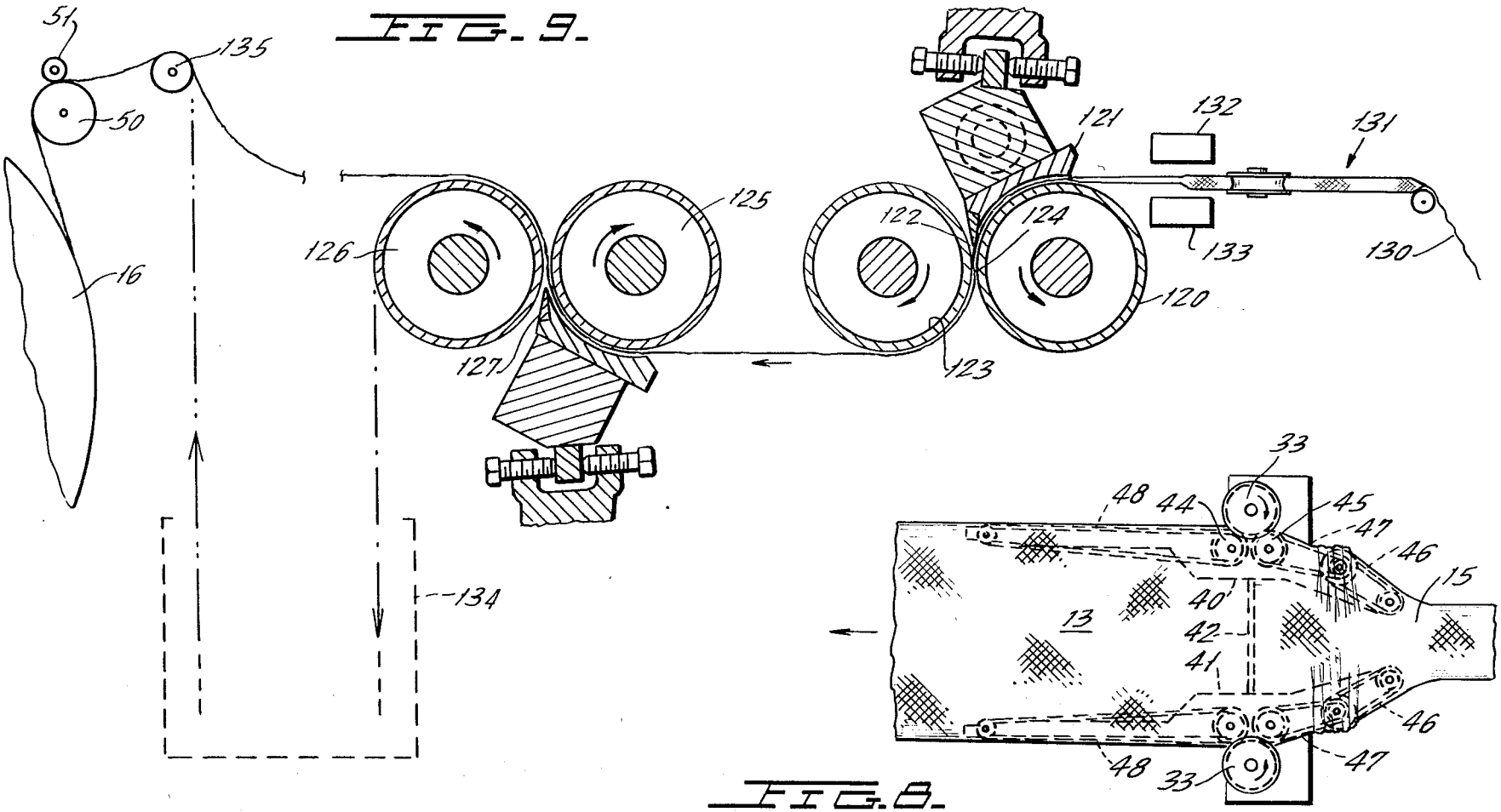
FIG. 8 is a simplified top plan view illustrating an advantageous form of entry end spreader incorporated in the system of FIG. 1.
FIG. 9 is a simplified, schematic illustration of a procedure for the wet compacting of tubular knitted fabric in conjunction with the drying system of the invention.

An advantageous form of spreader device useful in the system of the invention is that shown in FIG. 8 of the drawings. This spreader, may, for example, be generally in accordance with the teachings of the S. Cohn et al. U.S. Pat. No. 3,175,272, the disclosure of which is incorporated herein by reference. In that spreader arrangement, a pair of spaced spreader frames 40, 41 are arranged in adjustably spaced position by an adjustable spacing bar 42. The entire spreader frame is held between a pair of edge drive rolls 33 having concave peripheral contour and which are received snugly between adjacent pairs of belt driving sheaves 44, 45. On the entry side of the edge drive rolls, the frames support two pairs of entry drive belts 46, 47 which engage the incoming, narrow fabric by its internal edges and convey these edges divergently. At the juncture between the two sets of entry belts, the fabric is overfed from the upstream set of belts to the intermediate belts, which both accommodates for the shortening of the fabric and allows a readjustment of the fabric edges. In this respect, knitted fabric has a high degree of length/width geometric interdependency. When a knitted fabric is increased in width it is shortened in length and vice versa. Accordingly, where a high degree of lateral distention is involved, it is generally necessary to provide one or more stages of overfeed and edge readjustment of the fabric to avoid excessive edge-to-center distortions.

At the edge drive rolls, the fabric transfers to a discharge belt pair 48, usually with some degree of overfeed being provided as the fabric transfers from the belts 45 to the belts 48.

Figure 4:
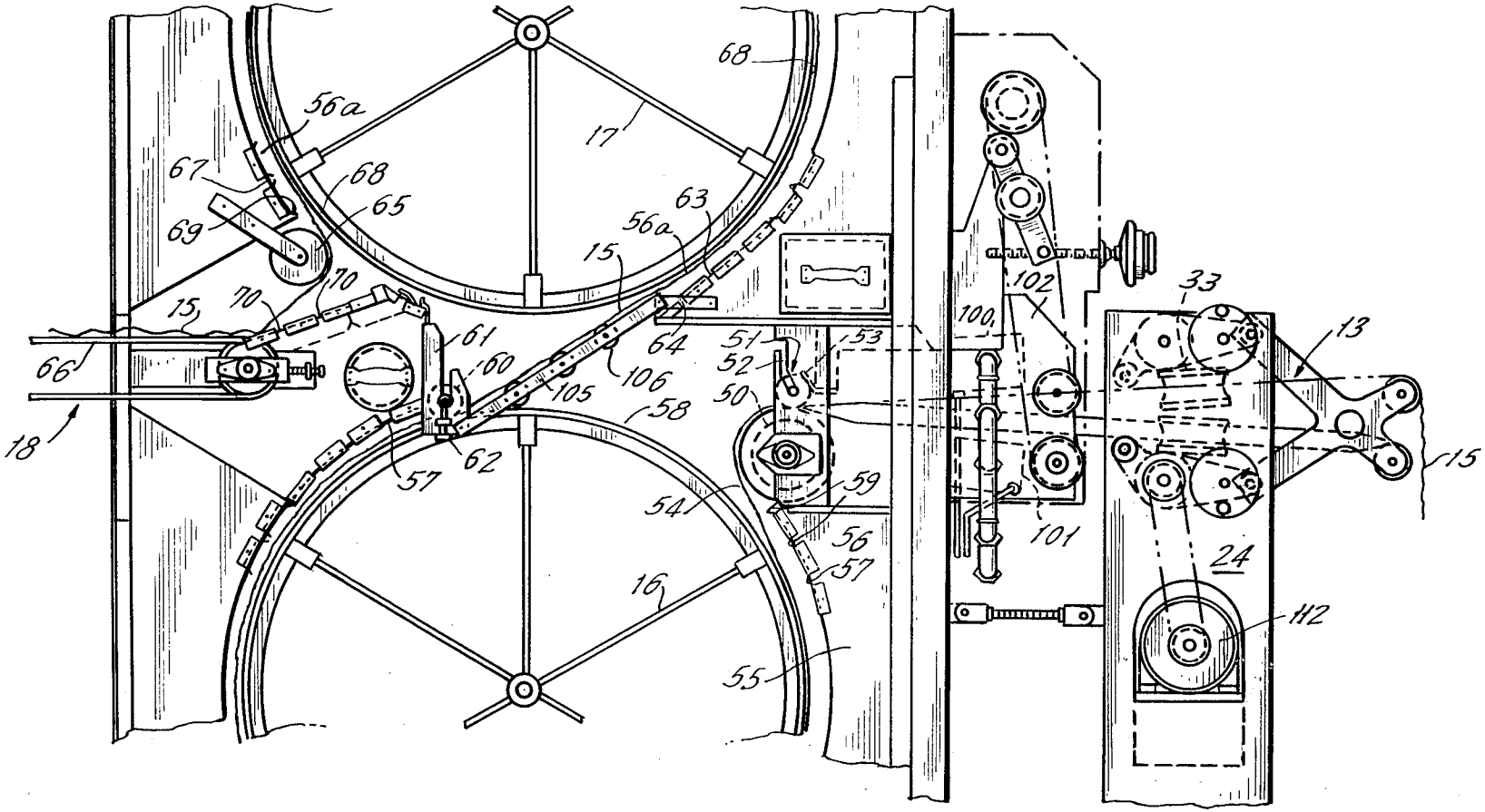
FIG. 4 is a fragmentary sectional view, illustrating details of the entry end of the dryer system of the invention.
Figure 5:
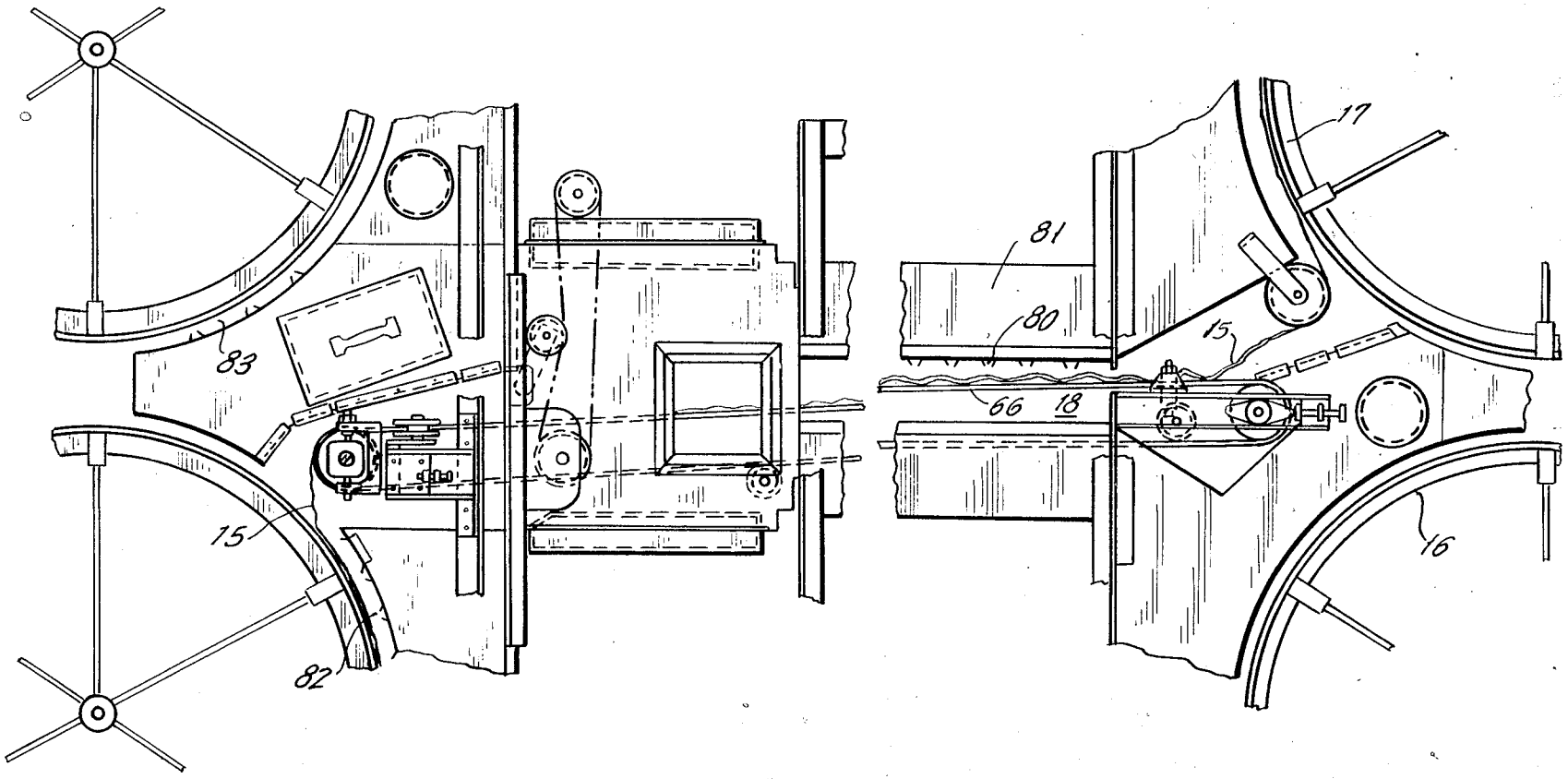
FIG. 5 is an enlarged, fragmentary illustration of a fabric transfer arrangement for the conveyance of fabric between first and second dryer stages.

As reflected in FIG. 4, incoming fabric 15, after passing over the entry spreader 13, is discharged onto the surface of an entry roller 50 which in part defines the entrance into the drying chamber of the first stage dryer. It will be noted in FIG. 4 that, if more than one spreader is utilized, both discharge at the entry roller 50, the arrangement being such that the fabric, which is wet and extremely unstable geometrically, is fully supported immediately upon its discharge from the spreaders. To this end, the discharge ends of the spreaders may literally rest upon the surface of the entry roller.

The entry opening of the dryer housing is defined in part by the entry roller 50 and in part by a small, lightweight roller 51, which is guided in a slot 52 and rests lightly by gravity upon the upper surface of the fabric. A resilient flap 53 bears against the gravity roller 51 to seal its upper surface area, and a similar seal (not shown) seals the lower portion of the larger diameter entry roller 50. The arrangement is such that the entry opening is effectively sealed off, bearing in mind that the adjacent interior of the dryer housing may be at an above-ambient pressure. The entry rollers 50, 51 also serves to prevent any "ballooning" of the fabric tube by reason of air which might otherwise be entrapped in the center of the tube.

Upon passage through the entry nip 50, 51, the fabric, fully supported by and in contact with the entry roller 50, is conveyed inward and downward by that roller. In this respect, the roller 50 is externally driven, at an accurately controllable speed, as will be further described, to assure tension free condition of the fabric 15.

As shown in FIG. 4, the entry roller 50 is positioned above and closely adjacent to an upper surface area of the first lower dryer reel 16. These reels typically may be on the order of four feet in diameter and may have an axial dimension of about six feet. Importantly, in the short transitional area 54 between the entry roller 50 and the lower first dryer reel 16, the fabric is kept as free as possible from external forces, particularly any "buffeting" effect of high velocity air nozzles used in the drying procedure. More particularly, as indicated in FIG. 4, the periphery of the dryer reel 16 is surrounded by a plenum chamber 55, which closely embraces most of the circumference of the reel, typically around 300°, for example. The plenum defines a relatively narrow cylindrical nozzle chamber 56 surrounding the dryer reel and into which chamber this fabric is advanced. Significantly, the first six or eight inches of this nozzle chamber are kept relatively free of buffeting air currents. A series of closely spaced, transversely disposed air nozzles 57 are formed in the plenum 55, arranged to direct high velocity jets of air radially toward the reel 16 and, of course, through the fabric supported thereon. The air thus supplied is heated to a relatively high temperature (e.g., 325° F.) and, as the fabric advances past the successive nozzles by movement of the dryer reel 16, it is alternately acted upon by a jet-like stream of air and then momentarily released from its effect.

It is significant that the dryer equipment utilized in the practice of the invention is a "pressure" dryer, as distinguished from a "suction" dryer. Although there is a great deal of similarity between the two, the differences, while subtle, are significant. In a "suction" dryer, drying air is drawn into the interior of the dryer reel from the entire area surrounding the reel, and the pattern of airflow through the reel, and therefore through the fabric, is determined by the pattern of openings in the reel. In a so-called "pressure" dryer, the reel is a more or less undefined, open mesh structure, and air enters the reel from defined nozzles surrounding the reel. The S. Cohn et al. U.S. Pat. No. 3,102,006, the disclosure of which is incorporated herein by reference, is representative of the construction of a "pressure" dryer, insofar as the nozzle and reel arrangement are concerned. As reflected in said patent, high velocity streams of air ar directed into said reels. The air is then withdrawn axially from said reels by blowers 140, reheated and recirculated together with make-up air.

Pursuant to the invention, the fabric in transfer from the entry roller 50 to the surface 58 of the lower reel 16 is allowed to pass through a generally quiescent area, such that the fabric is not "buffeted" by high velocity air streams, or stretched by being drawn prematurely to the surface of the dryer reel. To this end, the first active air nozzle 57 is located so as to act upon the fabric after it is fully supported by the dryer reel. Preferably, this is at a point generally at or lower than (as viewed in FIG. 4) the point of tangency of a line extending from the entry roll 50 to the surface 58 of the dryer reel 16. A more conventional pressure dryer of the type utilized herein normally has one or two nozzles 59 positioned in advance of that point, and in the illustrated structure, those nozzles 59 are either eliminated altogether or capped off.

While on the dryer reels, the fabric is effectively fully supported by the open mesh material forming the reel surface. To advantage, this surface 58 is formed of a four-by-four mesh of stainless steel wire (type 304, 0.047 inch diameter) of double crimp construction. This is generally similar to the structure of window screening, for example, although considerably more sturdy and with openings of approximately one quarter inch. This surfacing material has been determined to be relatively optimum in terms of its ability to support the fabric over its entire surface without distortion and at the same time minimize maintenance problems from the accumulation of resins from the fabric, for example.

Typically, the transversely extending nozzles 57 are spaced apart about three or four inches around the entire surface of the reel, up to approximately the point at which the fabric commences transfer from the lower reel to the upper reel. The last of a series of nozzles 57 is located a short distance in advance of a lightweight, free turning confining roller 60. The roller 60 is positioned at each end by a slotted bracket 61 and by adjustable stop bolts 62, which support the end bearings of the roller. The arrangement is such that the roller is positioned closely adjacent to but not in contact with the surface 58 of the lower reel, such that the fabric, emerging from what may be considered to be the lower nozzle chamber, is closely confined to but not nipped against the surface of the lower reel 16. Among other things, the roller 60 prevents "ballooning" of the fabric as it leaves the nozzle chamber, which might otherwise result if air were allowed to migrate freely within the fabric tube.

During its travel around the lower reel 16, considerable moisture has been removed from the fabric and it is beginning to assume a degree of geometric integrity. Nevertheless, it is important to give the fabric full width support during its transfer from the lower reel to the upper reel. Even the short distance between these reels is sufficient to permit drooping or downward curling of the fabric edge areas, which would result in unwanted tensions and, worse, uneven tensions across the fabric. Accordingly, pursuant to the invention, a transition support 105 is provided, which extends from the discharge end of the lower nozzle chamber, across the intervening space, to the entrance of what may be referred to as the upper nozzle chamber **56*a*. The transition support includes several lightweight free-turning rollers 106, which support the weight of the fabric as it transfers between the reels 16, 17**.

As in the case of the entrance to the lower nozzle chamber 56, the upper chamber is formed with a relatively quiescent entrance, allowing the fabric to be fully supported by the surface 58 of the upper reel 17, before being acted upon by the first effective nozzle 63. A nozzle opening 64, conventionally provided upstream of the nozzle 63, is either capped off or omitted altogether.

As will be explained more fully hereinafter, the working speeds of the several components are variably controlled by way of infinitely variable speed adjustments, providing for fine speed adjustments between the spreader unit 13, the driven entry roll 50, the lower dryer reel 16 and the upper dryer reel 17. These are all independently variable, so that close and careful control over the fabric advance is possible, enabling unwanted tensions to be avoided as the fabric geometry undergoes controlled changes during processing.

After passing around the upper dryer reel 17, the fabric emerges from the nozzle chamber **56*a* and passes around a guide roller 65. The fabric then advances to the surface of a first transfer conveyor 66. In the illustrated arrangement, the discharge end of the nozzle chamber 56*a* is designed such as to provide the last nozzle 67 at or upstream of the tangent point of the fabric 15 leaving the surface 68 of the dryer reel and advancing toward the guide roller 65. Nozzle openings 69, conventionally provided, are either eliminated or capped off, such that the fabric is not placed under tension by high velocity air directed toward it in an unsupported area. In the region between the guide roller 65 and the upstream end of the transfer conveyor 66, there are provided one or more levitating nozzles 70, which issue low velocity air, sufficient primarily to support the weight of the fabric 15 during its transfer to the conveyor belt 66**.

In accordance with one aspect of the invention, the conveyor belt 66 is operated at a controllable speed less than that of the effective surface speed of the upper dryer reel 17, such that the fabric is substantially overfed onto the surface of the conveyor. For example, the conveyor speed may be approximately 5% or so less than the surface speed of the upper reel. This will cause the fabric to gather slightly in a lengthwise direction on the surface of the conveyor belt 66, as indicated in FIGS. 1 and 4, for example.

In the procedure of the invention, a substantial amount of the moisture present in the fabric is removed in the first stage of drying, on reels 16, 17. During this drying process, there is a substantial change in the fabric geometry, including a substantial narrowing of the fabric width, as the fabric seeks an equilibrium condition. Importantly, by maintaining the strictest attention to detail and avoiding unnecessary tensions on the fabric, and by the manner of supporting the fabric and allowing the fabric to readjust slightly during drying by passage of successive nozzle areas, the geometric stabilization of the fabric is highly controlled and uniform. It is more or less progressive as the fabric advances about the first stage dryer reels, and appears to be substantially complete by the time the fabric reaches the first transfer conveyor 66. In a typical example, a jersey ingrain stripe fabric, of 50/50 poly/cotton construction, 30/2, eighteen gauge, twenty-six inch cylinder diameter, might be incoming at thirty-three inches from the Tri-Pad unit, overdistended to forty-two inches in the entry spreader 13, with an ultimate exit width from the system at about thirty-six and one-half inches. Not only is this a far greater width than can be realized with conventional equipment, but there is a high degree of uniformity in the finished fabric.

The fabric deposited on the belt 66 of the transfer conveyor 18 is fully supported underneath, so that no tensions, widthwise or lengthwise are imposed on the fabric. At this stage, it has already reached, substantially, its geometric equilibrium, such that little additional natural shrinkage occurs during the transfer operation. During this period, however, the drying and/or curing operations are continued, by directing hot air from nozzle elements 80 issuing defined streams of hot air from an upper plenum chamber 81. The conveyor belt 66 advantageously may be made of a mesh-like material to accommodate the passage of air through and about the fabric.

Advantageously, the dryer reels 20, 21 of the second stage are driven at a speed which is adjustable in relation to the speed of the upper reel 17 of the first stage dryer section 11. Since, at this stage, the fabric is substantially more geometrically stabilized, the upper reel 21 may be driven on a fixed one to one relationship with the lower dryer reel 20, although both preferably are variably driven from the first stage upper reel 17. Typically, the surface speed of the second stage reels 20, 21 may be slightly less than that of the first stage upper reel 17, although slightly greater than the speed of the conveyor belt 66. As a result, as the fabric approaches the discharge end of the conveyor belt, a portion of the overfeed slack is drawn out so that the fabric lies fairly flat on the surface of the dryer reel 20.

In general, the construction of the second stage dryer 12 is substantially consistent with that of the first stage dryer 11, in that the design of the nozzle chambers 82, 83 (see FIG. 6) is generally the same as the nozzle chambers 56, 56*a* of the first stage dryer. That is, provision is made for causing the fabric to enter the nozzle chamber and be supported by the adjacent mesh surface of the dryer reel, before the fabric is forcefully acted upon by the high velocity drying jets. Likewise, the fabric leaves the lower nozzle chamber 82, it is fully supported across its width by lightweight, friction free rollers 84 (FIG. 1) to avoid any edge drooping and resulting distortion.

After passing around the upper second stage reel 21, the fabric is discharged onto an exit conveyor 85, where it is carried by a belt 86 underneath nozzles 87 of a cooling air chamber 88. The fabric at this stage is fully dried and/or cured, and is cooled down to a level appropriate for handling and also to avoid overheating of the working area.

Figure 6:
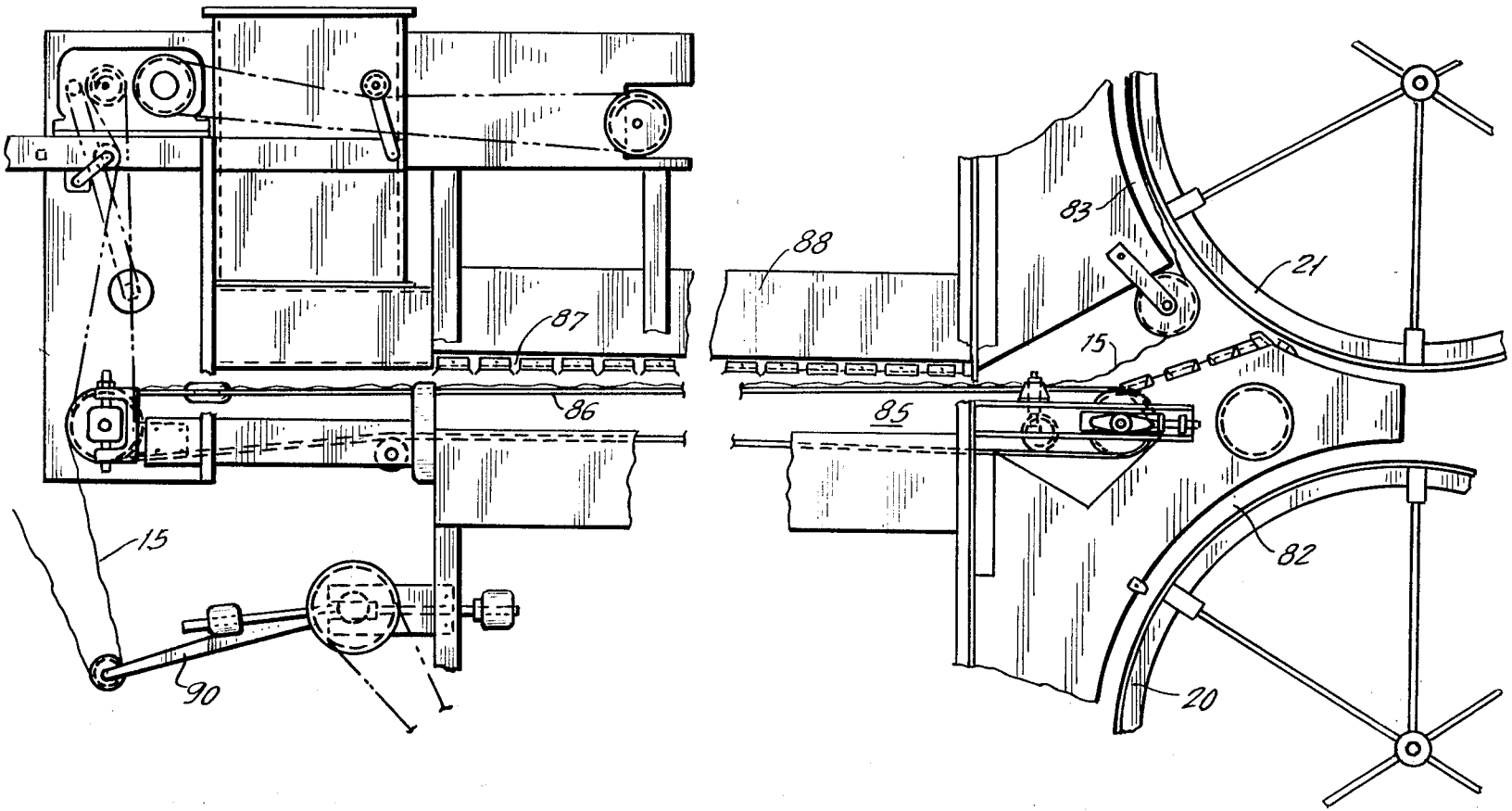
FIG. 6 is an enlarged, fragmentary sectional view of the discharge end of the dryer equipment.

As reflected in FIG. 6, the fabric discharged from the exit conveyor 85 is directed first downward around a speed controlled dancer roll 90, from whence it is directed upward through the guide rolls of the folding station 22 and ultimately deposited in folded relation on the pallet 23. The dancer roll 90 is lightweight and balanced, so as to exert a minimum force on the fabric. Its rotary position controls the speed of operation of the folder 22 such that, as the arm 90 rotates clockwise, the folding apparatus incrementally speeds up and vice versa. Typically, the folding apparatus includes an entry guide roller 91, a driven feed roller 92, and an oscillating guide roller 93, which travels back and forth over the pallet 23 to lay the fabric in predetermined folds.

Significantly, the tubular knitted fabric introduced into the entry end of the dryer system, although already wet, is steamed immediately in advance of such entry, advantageously by steam boxes 100, 101 (FIG. 4), which are located in a steam chamber 102 in front of the entry rollers 50, 51. The steam boxes are positioned above and below the plane or planes of the entry spreaders 13 and extend across the full width of the entry area. Steam boxes per se are of a well known type and serve to discharge steam in a more or less continuous jet or jets across the full width of the fabric, from above and below. This steaming operation is important to the end result, notwithstanding that the incoming fabric is already wet, containing in the case of aqueous processed fabrics, as much as 80 to 100% moisture content. The use of the steam, however, is materially beneficial in the overall result of the process of the invention in that, without it, not only is there an overall loss of width in the exit fabric, but in some ways more importantly, the width is not very uniform. In this respect, uniformity of width in the final product is of the utmost importance, because it is controlling factor in the eventual cutting operations. Thus, in the layout of cutting patterns on the cutting table, the minimum fabric width necessarily controls the manner in which patterns may be combined and laid out. If the fabric is wider in some places than others, that is translatable directly into fabric loss at the cutting table.

Following the procedure of the invention, as above described, results in significant economic advantages in the production of tubular knitted fabrics. The extraordinary nature of these advantages is reflected in the accompanying Table of Comparative Test Results, which reflect the processing of various types of fabrics in accordance with conventional procedures and in accordance with the invention.

COMPARATIVE TEST RESULTS

| Test # | Knit Construction | Standard Finished Width | Width Dryer Exit | One Or Two Pass | Resinated | Shrinkage Standard L × W % | Shrinkage Actual L × W % |
|---|---|---|---|---|---|---|---|
| | (Interlock) | | | | | | |
| (1) (c) | 50/50 Poly-Ctn-18GA-Dyed | 31" | 19½" | One | No | −6 × −12 | −4 × −16-23 |
| (n) | | 31" | 29" | One | No | −6 × −12 | −6 × −12 |
| (2) (c) | 50/50 Poly-Ctn-18GA-Dyed | 31" | 25" | Two | Yes | −5 × −5 | −6 × −7 |
| (n) | | 31" | 30" | One | Yes | −5 × −5 | −5 × −6 |
| (3) (c) | Stripe (1st = 100% Poly-2nd = 100% Cotton | 31" | 27" | Two | Yes | −5 × −5 | −7 × −8 |
| (n) | | 31" | 31" | One | Yes | −5 × −5 | −2.5 × −2.3 |
| | (Single Jersey) | | | | | | |
| (4) (c) | 50/50 Poly-Ctn Stripe 20 Cut | 34" | 29¾" | One | Yes | −5 × −5 | −4.0 × −7.4 |
| (n) | | 34" | 34" | One | Yes | −5 × −5 | −2.7 × −2.7 |
| (5) (c) | 50/50 Poly-Ctn Stripe 18 Cut | 30-31" | 28" | One | Yes | −5 × −5 | −6 × −7 |
| (n) | | 30-31" | 31" | One | Yes | −5 × −5 | −4 × −2.0 |
| (6) (c) | 50/50 Poly-Ctn Stripe 20 Cut | 32-33" | 30" | One | Yes | −5 × −5 | −6 × −7 |
| (n) | | 32-33" | 33" | One | Yes | −5 × −5 | −3 × −3 |
| (7) (c) | 50/50 Poly-Ctn Stripe 20 Cut | 30-31" | 28" | One | Yes | −5 × −5 | −6 × −7 |
| (n) | | 30-31" | 32" | One | Yes | −5 × −5 | −2 × −2 |
| (8) (c) | 100% Cotton 24 Cut | 31" | 27" | One | No | −5 × −10 | −12 × −10 |
| (n) | | 31" | 31½" | One | No | −5 × −10 | −6½ × −10 |
| | (Single Jersey) | | | | | | |
| (9) (c) | 100% Cotton 2 Ply Stripe | 26½" | Appx 25" | One | No | −5 × −5 | −8 × −10 |
| (n) | | 26½" | 28" | One | No | −5 × −5 | −3 × −10 |
| (10) (c) | Poly-Ctn 50/50 Stripe 18 Cut | 32" | 30½" | One | Yes | −5 × −5 | −4.3 × −4.0 |
| (n) | | 32" | 36" | One | Yes | −5 × −5 | −3.9 × −3.4 |
| (n) | | 32" | 34⅝" | One | Yes | −5 × −5 | −2.8 × −2.9 |
| | (Lacoste') | | | | | | |
| (11) (c) | 50/50 Poly-Cotton Stripe | 36½" | Appx 33" | One | No | −5 × −5 | −7 × −8 |
| (n) | | 36½" | 35" | One | No | −5 × −5 | −6 × −4.5 |
| (n) | | 36½" | 40¼" | One | No | −5 × −5 | −4.3 × −6.0 |
| (12) (c) | 100% Cotton (Dyed) | 36" | 31" | One | Yes | −5 × −5 | −7 × −7 |
| (n) | | 35" | 36" | One | Yes | −5 × −5 | −4 × −2.7 |
| (13) (c) | 100% Cotton Bleached | 36" | 30" | One | Yes | −5 × −5 | −7 × −7 |
| (n) | | 36" | 37" | One | Yes | −5 × −5 | −5 × 3.3 |

(c) = Conventional Procedure
(n) = New Procedure

In Test No. 1, eighteen gauge, dyed, interlock fabric 50/50 poly/cotton construction, unresinated, was processed to achieve a desired standard finished width of thirty-one inches. (Where fabric width on dryer exit was less than the standard finished width, a further width adjustment was performed as necessary.) The conventionally processed fabric exited the dryer at a width of 19½ inches, and had shrinkage characteristics far in excess of standard in the width direction. The same fabric processed in accordance with the invention exited the dryer at a width of 29" and had shrinkage characteristics meeting standards in both length and width directions.

In Test No. 2, using the same fabric as in test No. 1 but with the variation that the fabric was first impregnated with a heat curable resin, the conventional fabric was required to be processed in two separate passes. That is, it was first passed through the dryer under conditions to achieve drying but not curing of the resin. Thereafter, the dried fabric was given a calendering treatment to adjust the width of the fabric, and it was returned to the dryer for a second pass in which the heat curable resin was cured. The conventionally treated fabric, after two passes, exited the dryer at 25" in width and had ultimate shrinkage values of 7% in both length and width directions, against a standard of 5%. A similar fabric, processed in accordance with the invention, in a single pass, resulted in a significantly greater fabric width at dryer exit of thirty inches and shrinkage characteristics of 5% in length and 6% in width, thus achieving a much superior fabric in a single pass.

Test No. 3 was of a striped interlock, with alternate stripes of 100% polyester and 100% cotton, with the incoming fabric containing a heat curable resin. Against a standard finished width of 31", conventional processing, requiring two passes, delivered an exit width of 27 inches and length/width shrinkage of 7% and 8% respectively, versus a standard of 5% by 5%. The same fabric processed in accordance with the invention, in a single pass, achieved an exit width equal to the 31 inch standard and shrinkage characteristics substantially less than the allowable standard.

Tests No. 4–10 utilized single jersey type of fabric of various cuts or gauges, various fiber combinations, etc. All were finished in a single pass. A perusal of the table will indicate that in each instance, the procedure of the invention was able to deliver drier exit width equal to or exceeding the standard finished width, whereas conventional procedures in every case delivered a fabric less than the standard finish width. In addition, in each instance except one (Test No. 8), the procedure of the invention was able to achieve a fabric having length/width shrinkage characteristics better than standard, whereas in only one instance (Test No. 10) did the conventional procedure achieve shrinkage characteristics better than standard.

In Tests No. 11–13, with Lacoste'-type fabric, the procedure of the invention, in each case but one (Test No. 11), delivered an exit width equal to or exceeding the standard width, whereas conventional procedures in no instance achieved standard width at dryer exit. In case of Test No. 11, with 50/50 poly/cotton stripe, neither procedure achieved final shrinkage results up to the desired standard, although fabrics produced in accordance with the invention were clearly superior to the conventionally processed fabric and had significantly greater exit width from the dryer.

In all of the tests described above, dryer temperature was approximately 325° F. Moisture content of the incoming wet fabric at the entry spreader 13 was approximately 80% for all liquid-processed fabrics and approximately 25% for foam-processed fabrics. Liquid-processed fabrics were run at approximately 12 yards per minute, while foam-processed fabrics, with significantly lower incoming moisture content, were run at about 40–45 yards per minute.

As can be derived from the Table of Comparative Results, the procedures of the invention result in truly enormous economic benefits in the processing of tubular knitted fabrics. In most cases, it is possible to achieve a shrink-stable fabric at a finished width substantially exceeding standard requirements. Where this is possible, it enables the original fabric manufacturer—the knitter—to alter his knitting procedures to utilize less yarn in a given section of fabric without loss of quality. Quite apart from that, there are significant benefits to be realized in the finishing processes themselves, inasmuch as it is possible to finish the fabric in a single pass, and the finished fabric is either at the desired width or sufficiently close thereto that any final calendering operations require little effort, may be run easily and at high speed with a reliable, high quality of output.

Some of the benefits of the procedure are also realized at the extracting/wet processing phase at the Tri-Pad or similar equipment. Because the fabric can be greatly distended at the dryer entry spreader, it is not only possible but desirable to limit the spreading of the fabric at the Tri-Pad substantially to its natural, grey width. This greatly facilitates the operation of feeding the fabric onto the entry spreader for the Tri-Pad unit. In this respect, it is important for the operator at that stage to feed the fabric "on edge" to the Tri-Pad entry spreader. In the earlier processing of the fabric, there usually have been imparted to the fabric edge creases, which remain visible, even though the fabric at this stage may be in a highly disorganized, twisted, rope form. If the fabric is not fed into the Tri-Pad "on edge", an additional set of edge creases may be formed on the fabric, with attendant reduction in the ultimate fabric quality. With conventional procedures, where it is necessary to substantially distend the fabric at the Tri-Pad entry spreader, it is difficult for the entry operators to feed the fabric consistently on edge, because it is stretched so tightly over the entry spreader, and it is difficult to maintain uniform fabric quality. This problem is avoided altogether with the procedure of the present invention, since the fabric is not excessively distended at the Tri-Pad. The fabric which is subsequently fed into the dryer entry spreader, on the other hand, is either fed directly from the Tri-Pad or is neatly folded in flat form. In either case, the fabric has well defined edges, and it is quite easy for the fabric at that stage to be fed into the dryer entry spreader with "on edge" alignment.

Figure 7:
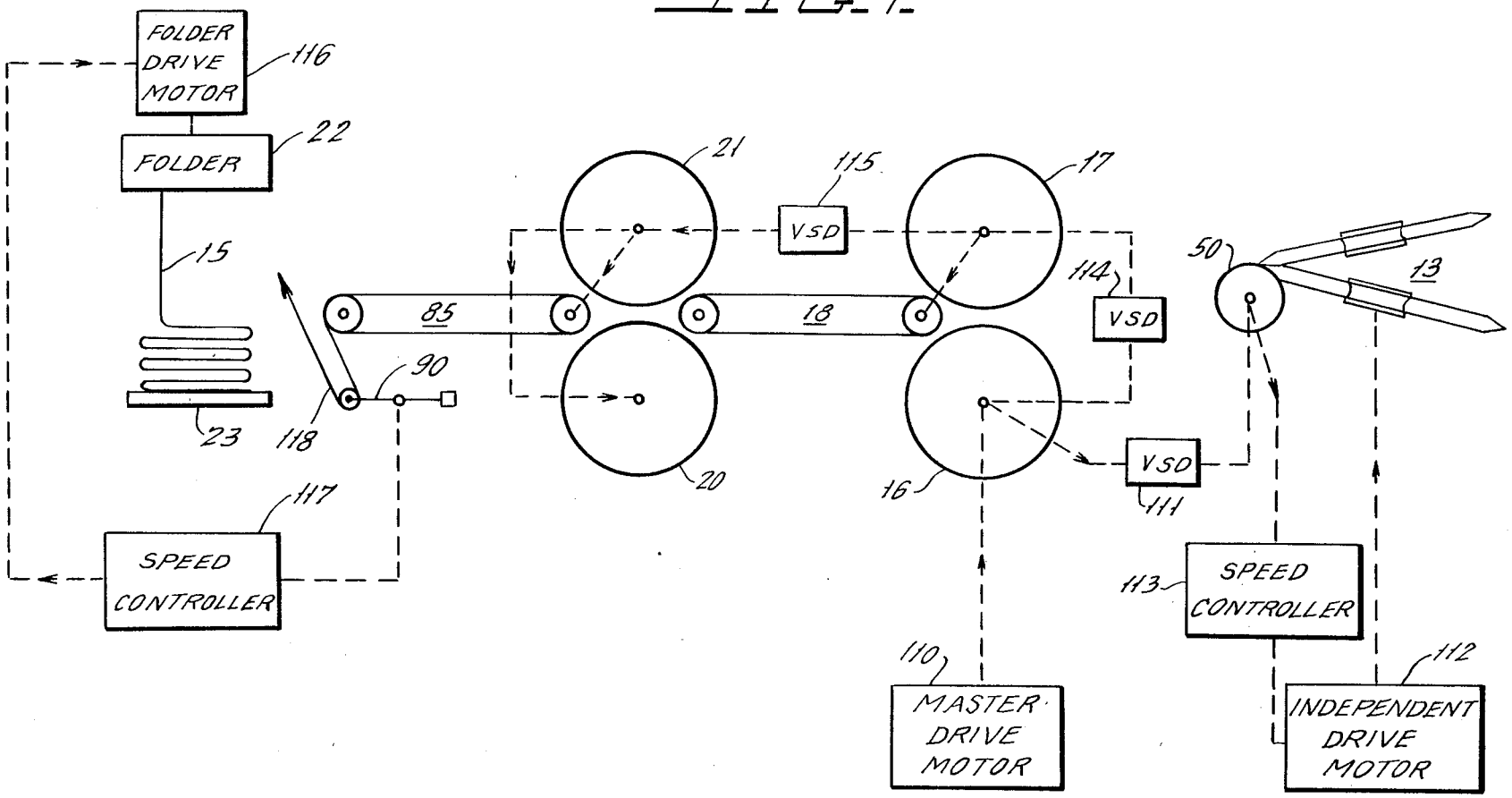
FIG. 7 is a highly simplified, schematic illustration of an advantageous form of drive arrangement for the dryer system of the invention.

In the equipment for processing the above described procedures, it is important to provide for control variability in the various interrelated elements which affect the movement of the fabric. An advantageous arrangement for this purpose is shown diagrammatically in FIG. 7.

In the illustrated arrangement, line speed is determined by a master drive motor 110, which is either a variable speed motor or is associated with an appropriate variable speed mechanism and serves to drive the lower first stage dryer reel 16. The speeds of all other elements of the system are controlled directly or indirectly from this master drive.

In the illustrated arrangement, the entry roller 50 is driven from the master drive via variable speed mechanism 111, typically a variable speed pulley arrangement of known design. This establishes a generally fixed speed ratio from the entry roller to the lower dryer reel, typically such as to provide a minor degree of overfeed to the reel and thereby prevent any tensions from developing in the fabric at this stage.

Fabric is supplied to the entry roller 50 from the entry spreader 13, and this is desirably driven by its own, independent drive motor 112. The speed of the motor 112 is controlled by a variable speed controller system 113, which includes so-called tach follower control means driven by the entry roller 50. The arrangement is such that speed of the spreader drive motor 112 is a controllable percentage function of the speed of the entry roller 50. This control facility allows for fine relative adjustment of the spreader speed as may be necessary to assure freedom of fabric tension as the wet fabric is deposited onto the driven entry roller 50.

The upper first stage dryer reel 17 advantageously is driven through a variable speed device 114, which enables the upper reel to be driven at an adjustable percentage of the speed of the lower reel. In this respect, it is usually appropriate to drive the upper reel at a slightly slower speed than the lower reel, to accommodate the natural stabilization process that the fabric undergoes during drying and, in particular, to avoid introducing tensions into the fabric resulting from such stabilization.

Typically and desirably, the wet fabric, after being steamed and distended substantially beyond its finished width at the entry spreader 13, undergoes a gradual and progressive stabilization in traversing the first stage dryer reels 16, 17, with the desire and intent that the fabric, when ready for discharge from the upper first stage dryer reel 17, be substantially in its final geometric configuration as to length and width, although typically the fabric is not fully stabilized, and the procedures of the invention include continued careful attention to detail in the handling of the fabric to prevent the inducement of tensions. To this end, the transfer conveyor 18 may typically be driven by direct drive connection from the upper dryer reel 17, although at a slightly slower speed. In a practical embodiment of the equipment, the conveyor may be operated at about 95% of the surface speed of the upper reel 17, which provides for a corresponding overfeed of the fabric onto the surface of the conveyor belt.

The second stage dryer reels 20, 21 advantageously may be driven at the same speed, by direct connection, with the entire unit being driven to a variable speed drive device 115, from the upper dryer reel 17. Desirably, the surface speed of the second stage dryer reels 20, 21 is slightly less than that of the first stage dryer reels 16, 17, but slightly higher than the surface speed of the transfer conveyor 18. Thus, when the loosely overfed fabric nears the end of the transfer conveyor 18, it is accelerated by the dryer reel 20, travelling at a slightly higher speed, although the speed relationships are such as to continue to avoid tensioning of the fabric.

The exit conveyor 85 may be driven directly from the upper second stage dryer reel 21, at a speed approximately equal to or perhaps slightly less than the speed of the dryer reel.

The folder 22 is driven by its own motor 116 through a speed control system 117 actuated by the balanced dancer roll 90. This is a standard demand feed device, which calls for the folder motor to be increased or decreased in speed as a function of the size of a fabric loop 118.

The invention contemplates that the Tri-Pad or other wet processing equipment acting on the fabric in advance of the dryer may be directly connected to the dryer. In such a case, the speed of the upstream equipment desirably is controlled on a demand basis, with respect to the speed of the dryer system, which is controlling overall. In view of the extreme geometric instability of the wet fabric, the controls utilized for such demand feed have to be particularly sensitive, so as not to induce tensions in the fabric. In some cases it may be appropriate for the operator of the Tri-Pad or other equipment to manually control the machine speed as a function of a short loop of fabric between the Tri-Pad or other equipment and the dryer. Likewise, optical or other sensing devices may be utilized to detect the condition of the loop.

In the procedure of the invention described above, a very significant aspect of the procedure is the substantial overdistention of the fabric, well beyond (i.e., 15%–100%) the desired finished width, at the entry spreader, accompanied by steaming of the wet fabric. This is immediately followed by a carefully controlled drying procedure, which allows the fabric to readjust, both lengthwise and widthwise on a controlled basis, to achieve a highly uniform, basically finished fabric upon exit from the dryer. Among other advantageous benefits from this procedure, is the substantial reorientation of the stitch structure of the fabric to restore the fabric to a more normal condition. In this respect, after tubular knitted fabric has undergone series of wet treatments, particularly certain types of dyeing procedures, the fabric may be greatly elongated from normal, and its cross lines are severely distorted. In the illustration of FIG. 2, for example, the reference numeral 118′ designates fabric cross stripes which, at the stage of entry to the dryer system, are grossly bowed and hooked, rather than extending straight across the fabric as desired. Conventionally, this requires the fabric to undergo fairly complicated stripe-straightening procedures during finishing operations separate from and subsequent to the drying operations. In the procedure of the present invention, however, the gross overdistention of the fabric at the entry spreader, in conjunction with steaming at that stage, and in conjunction with the highly controlled geometric readjustment and stabilization provided by the procedure, enables the fabric to be discharged at the exit end with stripes 119 which are straight and uniform and in condition where the fabric typically can be taken directly to the cutting table.

In accordance with another aspect of the invention, the drying line, without the entry spreading/steaming equipment, may be used to great advantage in tandem with mechanical compressive shrinkage equipment in a manner to enable tubular knitted fabric to be compressively preshrunk, or compacted, in a wet condition and then dried in the equipment of the invention without significant loss of the initial compacting effort.

Compacting of tubular knitted fabric is well known and widely practiced. One of the commercially important procedures for this purpose is reflected in the E. Cohn et al. U.S. Pat. Nos. 3,015,146 and 3,015,145 and shown diagrammatically in FIG. 9. In these procedures, tubular knitted fabric is initially distended to a predetermined width, steamed and then discharged onto a rotating feeding roller 120, being confined against the surface of such roller by means of an arcuate confining shoe 121 which tapers down to a tip 122. Opposing the feed roller 120 is a retarding roller 123, driven at a slightly slower speed. A short compacting chamber is defined by the shoe tip 122, as the upstream end, and the roller nip 124 defined by the respective feed and retarding rollers 120, 123. The tubular fabric is advanced into that chamber more or less at the speed of the feed roller 120 and is discharged therefrom more or less at the speed of the retarding roller 123, resulting in a gathering and lengthwise compacting of the fabric in the compacting zone. As the fabric exits from the zone, it is subjected to heat and rolling pressure to impart a degree of permanence to the compressive shrinkage effort.

Inasmuch as the procedure described above has an asymmetrical effect on the fabric, it is typically desired to perform the total compacting in two stages. The feed roller 125, retarding roller 126 and confining shoe 127 of the second stage are oriented reversely with respect to the first stage. The degree of compacting effort imparted at their respective first and second stages is adjusted in an effort to achieve front to back uniformity.

In the processing of dyed fabrics, particularly darker shades, asymmetrical compressive shrinkage processes, even when done in two stages, sometimes present difficulties in side to side color matching, because the compacting operation tends to abrade the fabric slightly and results in a tendency to lighten the shade of color. This sometimes can be compensated for by initially dyeing to a darker shade. In addition, post-compacting procedures have been developed for attempting to restore original coloration to compacted dyed fabrics.

It has been known that many of the color variation problems could be avoided by compacting the material in a wet condition. However, heretofore, this has not been feasible, because of the seemingly inevitable loss of compacting effect in the subsequent drying operations.

In the procedure of the invention, wet fabric 130 from a suitable supply (not shown) is fed onto an entry spreader mechanism 131. This may be of a known type, such as reflected in the beforementioned patents of E. Cohn et al. In the wet compacting procedure, it is not necessary to grossly overdistend the fabric, as in the earlier described drying procedure. Rather, the fabric is distended to a predetermined width, typically just slightly greater than the desired final width. While thus distended, the fabric is steamed by steam boxes 132, 133, which may be of a known type. The fabric then proceeds through the two stage, oppositely oriented compacting procedures in the usual manner except that, whereas in the compacting of dry fabrics it is customary and necessary to utilize heat in the compacting rollers, heat is unnecessary where the fabric is compacted in wet condition.

After the second stage of compacting, the compacted fabric can be either deposited in a temporary truck 134 for separate, batch drying, or it may be fed in-line directly to the dryer system. In either case, the fabric passes over an entry guide roller 135 and then into the dryer by way of the entry nip formed by the driven entry roller 50 and the opposed floating roller 51. The fabric is transferred from the last compacting stage into the entry nip 50, 51 free of tension, insofar as it is feasible to do so, and this may well include the controlled driving of the guide roller 135.

Once the compacted fabric is inside the drying chamber, it is processed substantially as described heretofore with respect to other fabrics, it being understood that the relative speeds of the various elements may have to be controlled slightly differently in the case of the compacted fabric, inasmuch as the fabric is not undergoing significant geometric adjustment of width and length as it passes through the dryer system. A primary concern, of course, in the drying of wet-compacted fabric is to avoid causing a lengthening of the fabric through the introduction of unwanted tensions.

The procedure of the invention represents a significant advance in the processing of dyed tubular knitted fabrics, particularly darker shades. In this respect, tubular knitted fabrics present a special problem involving color, because while the fabric has distinct "top" and "bottom" sides during processing, both the top and bottom sides are outside surfaces of the fabric, and any difference, front to back, is readily detectable at the line of demarcation. Even apart from that, however, any shade loss is undesirable from a processing standpoint. Accordingly, the procedures of the present invention, enabling tubular knitted fabric to be compacted successfully in the wet condition, constitute a significant advance in the art.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A process for finish treating of tubular knitted fabric in wet condition, which comprises (a) furnishing the wet fabric in flat, tubular form having a relatively uniform moisture content of at least about 25%, (b) guiding said fabric onto the entry section of a belt-type spreading device of a type characterized by having at least one set of driven entry belts for advancing and laterally distending said fabric, (c) distending said fabric laterally to a width not less than about 115% of the desired finished width of the fabric, calculated to result in the delivery of dried fabric substantially at finished width, (d) transferring said fabric to a second set of driven belts and advancing the wet distended fabric into a drying zone, (e) while said fabric remains on said second driven belts, directing steam onto the wet fabric, (f) transferring said wet, steamed and distended fabric through a transition zone onto the surface of a moving dryer reel in a manner to maintain said fabric as free as practicable of distorting tensions, (g) said transition zone ending at the line of tangency of said fabric with said reel, (h) supporting said fabric generally over its entire surface on said reel while advancing the fabric successively past a plurality of closely spaced nozzles directing individual streams of hot air in a generally radially inward direction at and through said fabric, (i) maintaining the fabric substantially free of the action of said streams of air during passage of said fabric through said transition zone, (j) transferring said fabric to a further rotating dryer reel, (k) advancing the fabric by said further reel at a speed somewhat less than the speed of advance imparted by the first reel, to accommodate geometric adjustment of the fabric in length and width while maintaining said fabric in flat tubular condition substantially free of distorting tensions, (l) continuing to convey the fabric on said further reel successively past a further plurality of closely spaced air nozzles directed radially inward at said reel, while supporting said fabric generally over its entire surface, (m) depositing said fabric on an exit conveyor while maintaining said fabric in flat tubular condition and at a width approximating the desired finished width of the fabric.

2. The process of claim 1, further characterized by (a) said wet fabric being furnished substantially at grey width and being distended laterally at least about 15% in width.

3. The process of claim 1, further characterized by (a) discharging the distended and steamed fabric directly onto the surface of an entry roller, (b) transferring the wet fabric through said transition zone which extends from said entry roller to the surface of the first mentioned dryer reel while maintaining a relatively quiescent ambient area in the vicinity of fabric traveling, through said zone and (c) conveying the fabric for a short distance on said reel before exposing the fabric to the first of the succession of said closely spaced hot air nozzles.

4. A process for finish treating of tubular knitted fabric in wet condition, which comprises (a) furnishing the fabric in flat, tubular form having a relatively uniform moisture content of at least about 25% and having readily visible edge demarcations, (b) guiding said fabric onto the entry section of a belt-type spreading device of a type characterized by having at least one set of driven entry belts for advancing and laterally distending said fabric, (c) maintaining the edges of the incoming fabric substantially aligned with the sides of said spreading device, (d) distending said fabric laterally to a width not substantially less than 115% of the desired finished width of the fabric calculated to enable the dried fabric to be delivered substantially at its desired finished width, (e) while said fabric remains thus distended, directing steam onto the wet fabric, (f) transferring said wet, steamed and substantially distended fabric through a transition zone and onto a moving open support surface in a manner to maintain said fabric in said zone as free as practicable of distorting tensions, (g) supporting said fabric generally over its entire surface on said surface while advancing the fabric successively past a plurality of closely spaced nozzles directing individual streams of hot air in a direction at and through said fabric, (h) the fabric in said transition zone being maintained substantially free of the action of air jets, from said nozzles, (i) accommodating geometric adjustment of the fabric in length and width during advancement of the fabric, while maintaining said fabric in flat tubular condition substantially free of distorting tensions, and (j) delivering fabric from said drier substantially in finished condition and substantially at the desired finished width.

5. The process of claim 4, further characterized by (a) during the drying of said fabric, transferring the fabric to a second moving open support surface travelling at a speed controllably less than the speed of the first moving surface, and (b) directing successive high velocity streams of air at and through the fabric on said second support.

6. The process of claim 4, further characterized by (a) discharging the distended fabric directly from the distending device onto a driven entry roller, (b) conveying the fabric by said entry roller through said transition zone toward said open support surface and transferring said fabric onto said surface, and (c) maintaining said fabric substantially quiescent and free of the effects of said individual streams of hot air while said fabric is in said transition zone and until said fabric is fully supported on said open support surface.

7. The process of claim 4, wherein (a) said fabric contains a heat-settable component, (b) after geometric adjustment of said fabric continuing the action of said streams of hot air until said heat-settable component is heat set.

* * * * *